US009215937B2

(12) United States Patent
Serhan

(10) Patent No.: US 9,215,937 B2
(45) Date of Patent: Dec. 22, 2015

(54) ADJUSTABLE SIDE RAIL FOR MEDICAL BEDS AND THE LIKE

(71) Applicant: Drive Medical Design & Mfg., Port Washington, NY (US)

(72) Inventor: Michael Serhan, Acadia, CA (US)

(73) Assignee: Drive Medical Design & Mfg., Port Washington, NY (US)

( * ) Notice: Subject to any disclaimer, the term of this patent is extended or adjusted under 35 U.S.C. 154(b) by 348 days.

(21) Appl. No.: 13/826,449

(22) Filed: Mar. 14, 2013

(65) Prior Publication Data

US 2014/0259402 A1 Sep. 18, 2014

(51) Int. Cl.
*A47C 21/08* (2006.01)
*A61G 7/05* (2006.01)

(52) U.S. Cl.
CPC ..... *A47C 21/08* (2013.01); *A61G 7/0507* (2013.01); *A61G 2007/0509* (2013.01); *A61G 2007/0513* (2013.01)

(58) Field of Classification Search
CPC ..... A61G 7/0507; A61G 2007/0507; A61G 2007/0508; A61G 2007/0509; A61G 2007/051; A61G 2007/0512; A61G 2007/0513; A61G 2007/0514; A61G 2007/0516; A61G 2007/052; E05C 5/00; E05C 2005/005; E05C 9/04; A47D 9/005; A47D 13/061; A47C 21/08
USPC ..... 5/425, 428, 430; 292/4–7, 57–61, 63, 292/64, 66
See application file for complete search history.

(56) References Cited

U.S. PATENT DOCUMENTS

| | | | | |
|---|---|---|---|---|
| 5,781,945 | A * | 7/1998 | Scherer et al. | 5/426 |
| 6,058,531 | A * | 5/2000 | Carroll | 5/430 |
| 6,240,583 | B1 * | 6/2001 | Brooke et al. | 5/662 |
| 6,519,794 | B1 * | 2/2003 | Aarestad et al. | 5/430 |
| 6,728,985 | B2 * | 5/2004 | Brooke et al. | 5/662 |
| 7,039,971 | B2 * | 5/2006 | Sebastien | 5/662 |
| 7,257,850 | B1 * | 8/2007 | Tekulve | 5/430 |
| 7,686,354 | B2 * | 3/2010 | Jasper | 292/33 |
| 7,779,494 | B2 * | 8/2010 | Poulos et al. | 5/618 |
| 2003/0056293 | A1 * | 3/2003 | Brooke et al. | 5/662 |
| 2006/0080776 | A1 * | 4/2006 | Clapper et al. | 5/93.1 |
| 2006/0085912 | A1 * | 4/2006 | Kuek et al. | 5/430 |
| 2008/0211238 | A1 * | 9/2008 | Stevens | 292/163 |
| 2012/0037869 | A1 * | 2/2012 | Fiore et al. | 256/25 |
| 2012/0233774 | A1 * | 9/2012 | Zerhusen | 5/425 |
| 2014/0259402 | A1 * | 9/2014 | Serhan | 5/430 |

* cited by examiner

*Primary Examiner* — Nicholas Polito
(74) *Attorney, Agent, or Firm* — Carter, DeLuca, Farrell & Schmidt, LLP

(57) ABSTRACT

An adjustable side rail assembly includes a side rail and an actuation assembly. The side rail is rotatable between a storage position and a use position. The actuation assembly includes an inner member, an outer member, and a locking assembly. The outer member is coupled to the side rail and is rotatable relative to the inner member between first and second rotational orientations for rotating the side rail between the storage and use positions, respectively. The locking assembly is transitional between a locked condition, wherein the locking assembly engages both the inner and outer members to fix the inner and outer members in the first or second rotational orientation, and an unlocked condition, wherein the locking assembly is disengaged from the inner and/or outer member to permit rotation of the outer member relative to the inner member between the first and second rotational orientations.

18 Claims, 8 Drawing Sheets

ADJUSTABLE SIDE RAIL FOR MEDICAL BEDS AND THE LIKE

BACKGROUND

1. Technical Field

The present disclosure relates to medical beds and, more particularly, to adjustable side rails for use with medical beds.

2. Background of Related Art

Adjustable beds are used in both home care and in more formalized medical settings, e.g., hospital rooms. Adjustable beds generally include a fixed frame, adjustable leg assemblies supporting the fixed frame, and an articulating bed frame coupled to the fixed frame and configured to support a mattress thereon. The adjustable leg assemblies permit height adjustment of the fixed frame relative to the floor, while the articulating bed frame is selectively articulatable to orient the patient in a desired position, e.g., a lying position, a sitting position, etc. Thus, adjustable beds can be adapted for use in various different configurations, depending on the setting, e.g., home care or hospital, the condition of the patient, treatment protocol, or other factors.

In some instances, it is necessary to provide side rails on either or both sides of the bed. However, because not all situations call for either or both side rails, it is desirable that the side rails be capable of being readily installed and removed or that the side rails be adjustable between a use position and a storage position.

SUMMARY

In accordance with the present disclosure, an adjustable side rail assembly is provided. The adjustable side rail assembly includes a side rail rotatable between a storage position and a use position, and an actuation assembly. The actuation assembly includes an inner member, an outer member, and a locking assembly. The outer member is coupled to the side rail and is rotatable relative to the inner member between first and second rotational orientations for rotating the side rail between the storage and use positions, respectively. The locking assembly is transitional between a locked condition and an unlocked condition. In the locked condition, the locking assembly engages both the inner and outer members to fix the inner and outer members in first or second rotational orientation (depending on the relative positioning of the inner and outer members). In the unlocked condition, the locking assembly is disengaged from one or both of the inner and outer members to permit rotation of the outer member relative to the inner member between the first and second rotational orientations.

In embodiments, the inner member defines first and second slots extending therethrough and the outer member defines third and fourth slots extending therethrough. In such embodiments, the locking assembly includes a pair of fingers configured for releasable engagement within the slots of the inner and outer members to lock the inner and outer members in the first and/or second rotational orientations.

In embodiments, the fingers are configured for engagement within: the first and third slots and the second and fourth slots to lock the inner and outer members in the first rotational orientation; and the first and fourth slots and the second and third slots to lock the inner and outer members in the second rotational orientation.

In embodiments, the actuation assembly further includes an actuator pivotably coupled to the pair of fingers. In such embodiments, the actuator is translatable between a first position for locking the inner and outer members in the first or second rotational orientations, and a second position permitting rotation of the outer member relative to the inner member.

In embodiments, the actuator includes a handle extending from the inner and outer members that is configured for manual manipulation to translate the actuator between the first and second positions. Further, the actuator may be biased towards the first position.

In embodiments, in the first position of the actuator, the fingers extend perpendicularly from the actuator while, in the second position of the actuator, the fingers extend obliquely from the actuator.

In embodiments, the outer member further includes an outer housing fixedly disposed about the outer member. The outer housing engages a portion of the side rail therein.

In embodiments, the inner member includes an extension portion extending through the outer member. The extension portion includes a clamping mechanism for releasably engaging the actuation assembly to a bed frame.

In embodiments, the side rail includes a body portion having at least one extension segment configured to inhibit a patient from being caught between the side rail and a bed.

In embodiments, the side rail includes a "C"-shaped portion and an extension portion. The "C"-shaped portion is secured to the outer member at a first end thereof and has the extension portion extending from a second end thereof.

In embodiments, a cover plate engaged to the side rail and disposed within a saddle defined by the "C"-shaped portion is provided.

Another adjustable side rail assembly provided in accordance with the present disclosure includes a side rail and an actuation assembly. The side rail is rotatable between a storage position and a use position. The actuation assembly includes an inner member, and outer assembly, and a pair of pivotable locking fingers. The inner member includes first and second opposed slots. The outer assembly is rotatably disposed about the inner member and includes the side rail secured thereto such that rotation of the outer member about the inner member between first and second rotational orientations effects rotation of the side rail between the storage and use positions, respectively. The outer assembly includes third and fourth opposed slots. In the first rotational orientation, the first and third slots are aligned with one another and the second and fourth slots are aligned with one another. On the other hand, in the second rotational orientation, the first and fourth slots are aligned with one another and the second and third slots are aligned with one another. The pivotable locking fingers are movable between: a storage locked condition, wherein one finger extends through both the first and third slots and the other finger extends through both the second and fourth slots to lock the side rail in the storage position; a use locked condition, wherein one finger extends through both the first and fourth slots and the other finger extends through both the second and third slots to lock the side rail in the use position; and an unlocked condition, wherein the fingers are disengaged from at least the third and fourth slots to permit rotation of the side rail between the storage and use positions. The adjustable side rail assembly may further be configured similar to any of the above-described embodiments.

BRIEF DESCRIPTION OF THE DRAWINGS

Various embodiments of the presently disclosed adjustable bed system and components thereof are described with reference to the accompanying drawing figures, wherein.

DETAILED DESCRIPTION

Various exemplary embodiments of the presently disclosed subject matter will now be described in detail with reference to the drawings, wherein like references characters identify similar or identical elements.

Figure 1:
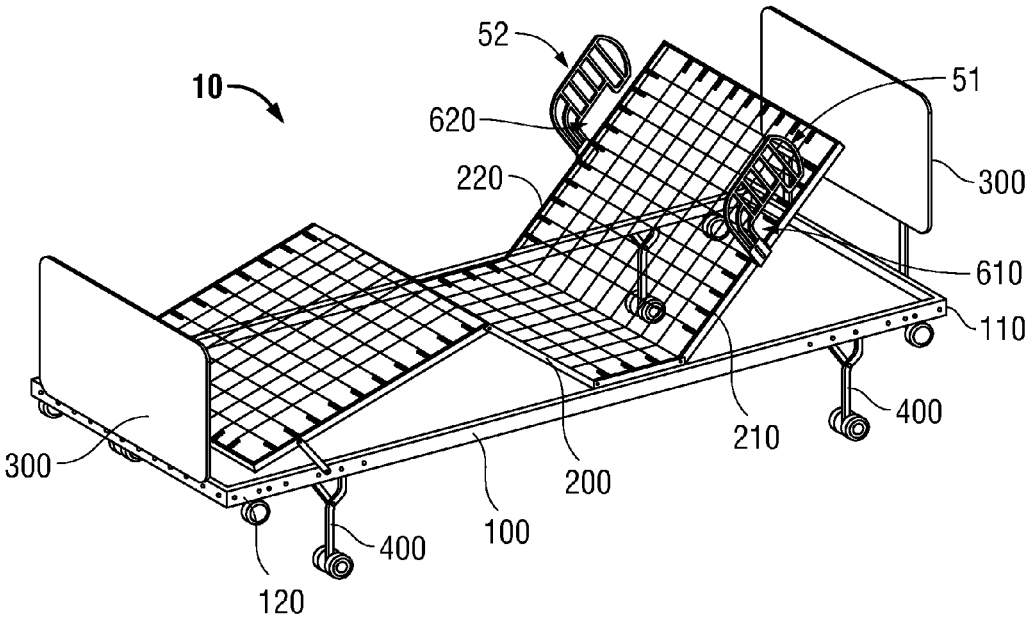
FIG. 1 is a side, perspective view of an adjustable bed provided in accordance with the present disclosure, wherein the adjustable bed is disposed in an articulated configuration and the side rails are disposed in a use position.
Figure 2:
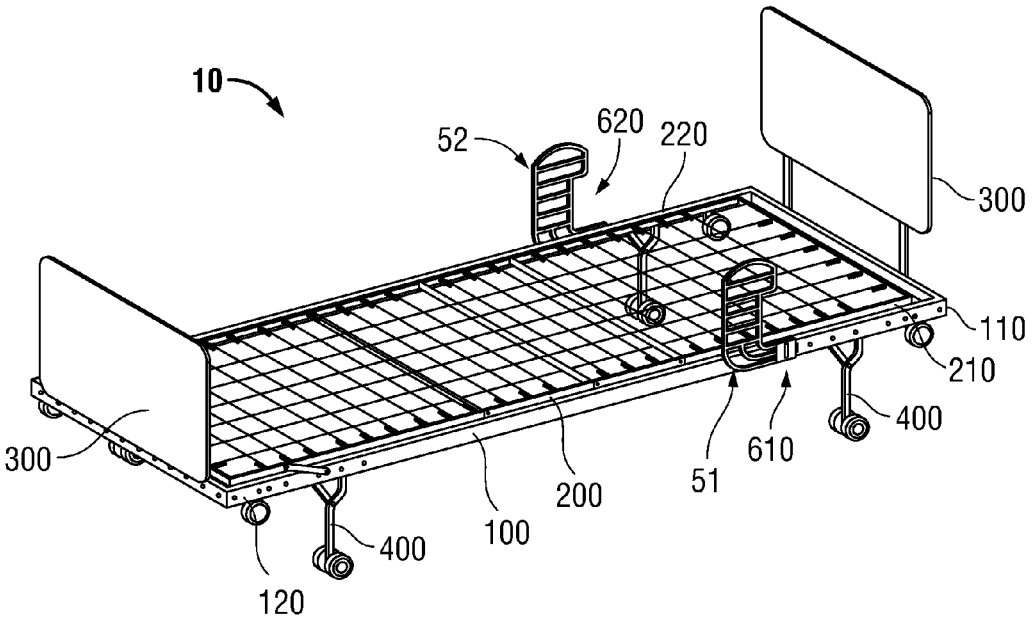
FIG. 2 is side, perspective view of the adjustable bed of FIG. 1, wherein the adjustable bed is disposed in a flat configuration and the side rails are disposed in a storage position.

Turning now to FIGS. 1-2, an adjustable bed system provided in accordance with embodiments of the present disclosure is shown generally identified by reference numeral 10. Bed system 10 may find application in both hospital settings as well as in private home care settings. Bed system 10 generally includes a fixed frame 100, an articulatable frame 200 articulatably mounted on fixed frame 100, head and foot end board assemblies 300 coupled to fixed frame 100 at respective head and foot ends 110, 120 thereof, first and second leg assemblies 400 positioned towards the respective head and foot ends 110, 120 of fixed frame 100, and first and second side rails 51, 52 coupled to articulatable frame 200 and extending along first and second sides 210, 220, respectively, thereof. Although side rails 51, 52 are shown in FIGS. 1 and 2 as being disposed on bed system 10, it is contemplated that side rails 51, 52 be configured for use in conjunction with any suitable bed system and that side rails 51, 52 be configured for mounting on any suitable portion of a bed system, e.g., side rails 51, 52 may be mounted on an articulatable frame, a fixed frame, etc.

Side rails 51, 52, as will be described in greater detail below, are configured to transition, e.g., rotate, between a use position (FIG. 1), wherein side rails 51, 52 are positioned to inhibit a patient from falling out of bed, and a storage position (FIG. 2), wherein side rails 51, 52 are stowed so as not to substantially interfere with the patient or caregivers. However, in the storage position, despite being stowed, side rails 51, 52 remain operable to provide a support to facilitate the patient's ability to sit up, get out of bed, reposition him/herself, etc. Further, an actuation assembly 610, 620 couples each side rail 51, 52, respectively, to articulatable frame 200 to facilitate rotating side rails 51, 52 between the use and storage positions and locking side rails 51, 52 in each of the use and storage positions. Particular features, use, and operation of side rail 51 and actuation assembly 61 thereof are described in detail below. Side rail 52 and actuation assembly 620 thereof are similar to side rail 51 and actuation assembly 610 and, thus, will not be described below to avoid unnecessary repetition. Other embodiments of side rails 510, 5100 (FIGS. 4A-5B and 6, respectively) will also be described below, keeping in mind that any or all of the features of the side rails described herein may be used in conjunction with any of the other side rails.

Figure 3A:
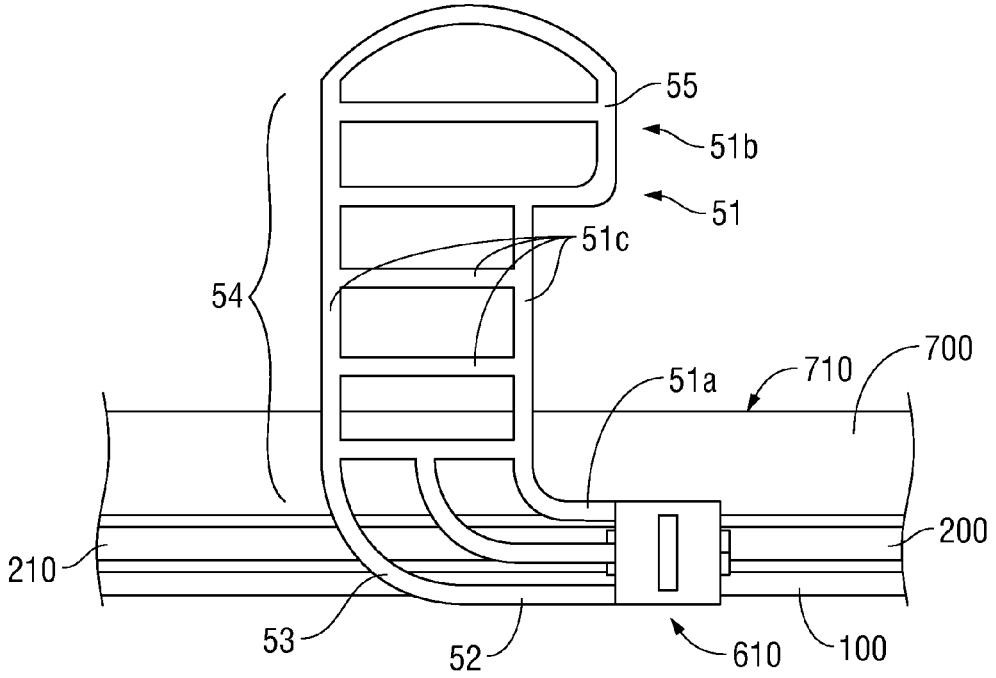
FIG. 3A is an enlarged, side view of one of the side rails of the adjustable bed of FIG. 1, wherein the side rail is disposed in the storage position.
Figure 3B:
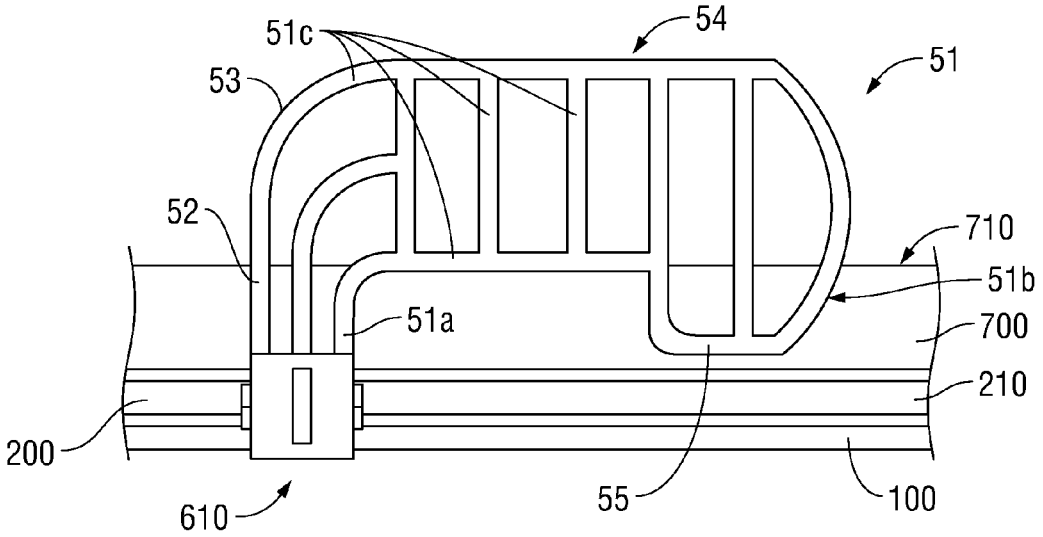
FIG. 3B is an enlarged, side view of the side rail of FIG. 3A, disposed in the use position.

Turning now to FIGS. 3A-3B, side rail 51 is shown coupled to first side 210 of articulatable frame 200 of bed system 10 via actuation assembly 610. A mattress 700 is disposed atop articulatable frame 200. Side rail 51 generally includes an attachment portion 52, a curved connector portion 53, a body portion 54, a pivotable end 51*a*, and a free end 51*b*. Pivotable end 51*a* of side rail 51 is defined at the free end of attachment portion 52 and is pivotably coupled to actuation assembly 610, which will be described in greater detail below. Curved connector portion 53 defines a 90 degree curved configuration and interconnects attachment portion 52 and body portion 54 such that attachment portion 52 and body portion 54 are substantially perpendicular relative to one another. Body portion 54 extends from curved connector portion 53 to define free end 51*b* of side rail 51. As such, free end 51*b* of side rail 51 is both vertically and horizontally offset relative to pivotable end 51*a* thereof. Body portion 54 of side rail 51 further includes an enlarged, downwardly-extending end member 55 disposed at free end 51*b* of side rail 51 that is configured to extend beyond upper surface 710 of mattress 700 inhibit a patient from extending any body part between side rail 51 and mattress 700 and getting caught therebetween. Side rail 51 may be formed from any suitable material via any suitable process. For example, side rail 51 may be formed from a plurality of spaced-apart bars 51*c* interconnected with one another, although other configurations are also contemplated.

As mentioned above, side rail 51 is configured to rotate between a storage position (FIG. 3A) and a use position (FIG. 3B). More specifically, side rail 51 is rotatable about pivotable end 51*a* thereof and relative to actuation assembly 610 between the storage position (FIG. 3A) and the use position (FIG. 3B). Actuation assembly 610 is operable to lock side rail 51 in the storage and use positions once the desired position has been achieved, and to unlock side rail 51 when rotation of side rail 51 between the storage and use positions is desired.

In the storage position of side rail 51, as shown in FIG. 3A, body portion 54 of side rail 51 extends in a generally vertically-upward direction when articulatable frame 200 is disposed in a flat or non-articulated position. In this position side rail 51 does not interfere with a patient getting into or out of bed system 10 (FIGS. 1-2) but still provides a grasping surface and/or support to facilitate the patient's ability to sit up, get out of bed, reposition him/herself, etc. On the other hand, in the use position of side rail 51, as shown in FIG. 3B, body portion 54 of side rail 51 is oriented in generally parallel orientation relative to upper surface 710 of mattress 700.

More specifically, body portion 54 is sufficiently displaced above and extends sufficiently along upper surface 710 of mattress 700 so as to inhibit a patient from falling out of bed and to provide a grasping surface and/or support to facilitate the patient's ability to sit up, reposition him/herself, etc.

Figure 4A:
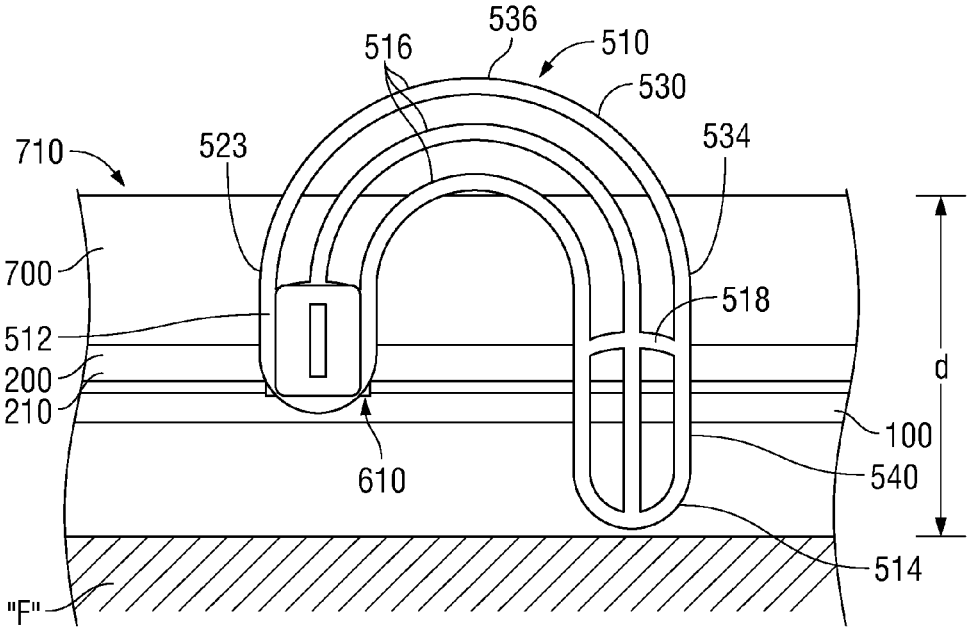
FIG. 4A is an enlarged, side view of another embodiment of a side rail configured for use with the adjustable bed of FIG. 1, wherein the side rail is disposed in the storage position.
Figure 4B:
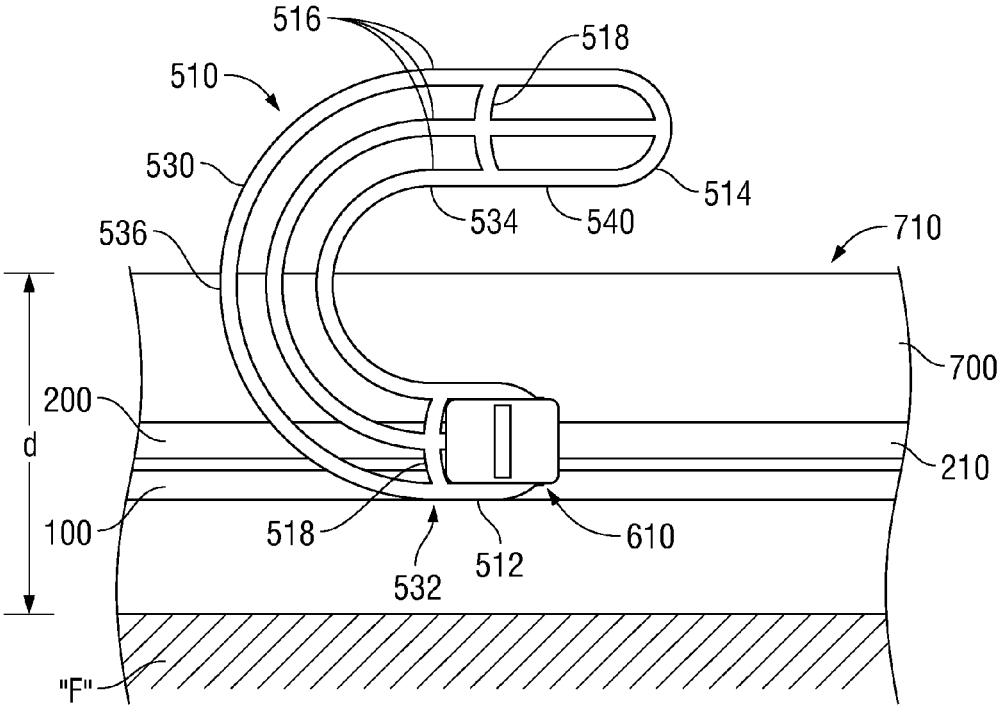
FIG. 4B is an enlarged, side view of the side rail of FIG. 4A, disposed in the use position.

With reference to FIGS. 4A-4B, another embodiment of a side rail 510 is shown coupled to first side 210 of articulatable frame 200 of bed system 10 (FIG. 1) via actuation assembly 610. Mattress 700 is disposed atop articulatable frame 200. Upper surface 710 of mattress 700 is spaced-apart a distance "d" from floor "F." Distance "d" corresponds to the minimum height of bed system 10 (FIG. 1). As can be appreciated, depending upon the position of leg assemblies 400 (FIGS. 1 and 2), e.g., whether leg assemblies 400 (FIGS. 1 and 2) are disposed in a contracted position, an extended position, or an intermediate position therebetween, the height of bed system 10 (FIG. 1) relative to floor "F" may be vary between the minimum distance "d," a maximum distance defined by the fully extended position of leg assemblies 400 (FIGS. 1 and 2), and one or more intermediate positions therebetween. Bed system 10 (FIG. 1) may define a minimum distance between articulatable frame 200 and floor "F" of about 7 inches, while mattress 700 may define a thickness of about 6 inches, such that the minimum distance "d" is about 13 inches, although other configurations and dimensions are also contemplated.

Side rail 510 generally includes a curved, generally "C"-shaped portion 530, a linear extension portion 540, a pivotable end 512, and a free end 514. Pivotable end 512 of side rail 510 is pivotably coupled to actuation assembly 610, which will be described in greater detail below, and is defined at first end 532 of "C"-shaped portion 530. Linear extension portion 540 extends from a second end 534 of "C"-shaped portion 530 to free end 514 of side rail 510. As such, free end 514 of side rail 510 is both vertically and horizontally offset relative to pivotable end 512 thereof. Side rail 510 may be formed from any suitable material via any suitable process. For example, side rail 510 may be formed from a plurality of spaced-apart bars 516 interconnected with one another at pivotable and free ends 512, 514, respectively, of side rail 510 and/or via one or more cross-braces 518, although other configurations are also contemplated.

Similarly as described above with respect to side rail 51 (FIGS. 3A-3B), side rail 510 is configured to rotate between a storage position (FIG. 4A) and a use position (FIG. 4B). In the storage position of side rail 510, as shown in FIG. 4A, linear extension portion 540 of side rail 510 extends in a generally vertically-downward direction towards floor "F" when articulatable frame 200 is disposed in a flat or non-articulated position. However, in this position, linear extension portion 540 extends downwardly from upper surface 710 of mattress 700 a distance less than or equal to the minimum distance "d," e.g., less than or equal to 13 inches, such that side rail 510 is permitted to be disposed in the storage position even when bed system 10 (FIG. 1) defines a minimum height. Further, in the storage position, apex 536 of "C"-shaped portion 530 of side rail 510 extends vertically-upwardly beyond upper surface 710 of mattress 700 to provide a grasping surface and/or support to facilitate the patient's ability to sit up, get out of bed, reposition him/herself, etc. However, with only apex 536 of "C"-shaped portion 530 extending vertically upwardly beyond upper surface 710 of mattress 700, side rail 510 remains substantially disposed in a stowed condition so as not to interfere with the patient and/or caregivers. On the other hand, in the use position of side rail 510, as shown in FIG. 4B, "C"-shaped portion 530 is oriented such that linear extension portion 540 is vertically displaced above upper surface 710 of mattress 700 and extends in generally parallel orientation relative thereto. More specifically, linear extension portion 540 is sufficiently displaced above upper surface 710 of mattress 700 so as to inhibit a patient from falling out of bed and to provide a grasping surface and/or support to facilitate the patient's ability to sit up, reposition him/herself, etc.

Figure 5A:
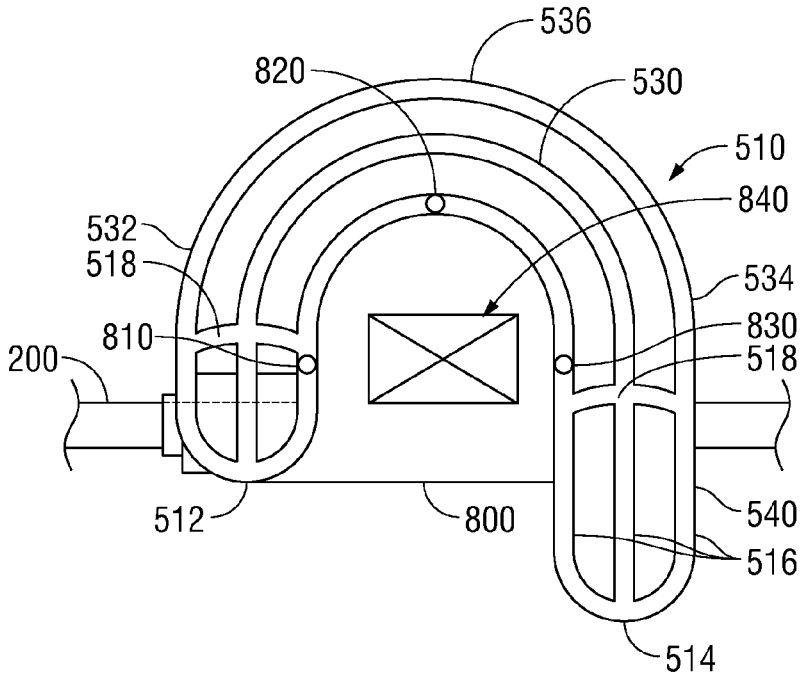
FIG. 5A is a side view of the side rail of FIG. 4A disposed in the storage condition and including a cover plate attached thereto.
Figure 5B:
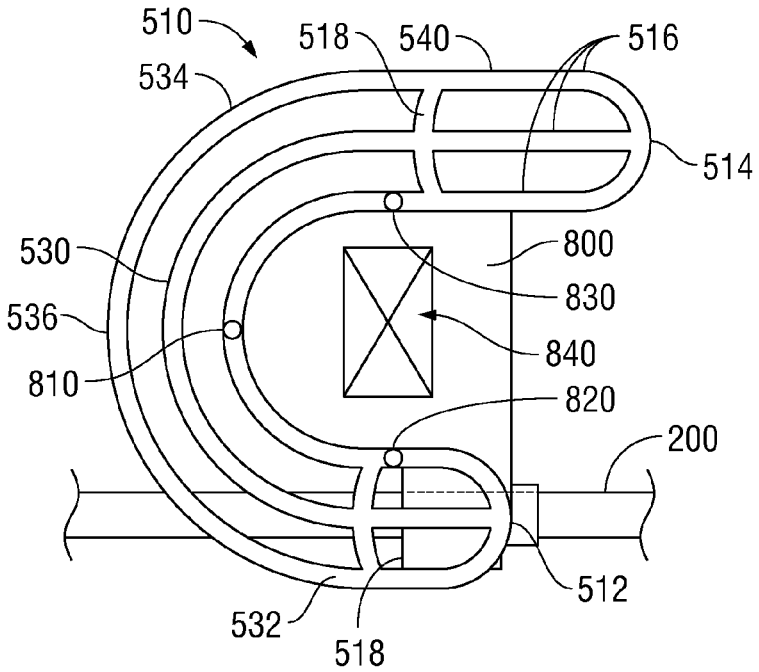
FIG. 5B is a side view of the side rail of FIG. 5A disposed in the storage condition and including the cover plate of FIG. 5A attached thereto.

Turning now to FIGS. 5A-5B, side rail 510 is shown including a cover plate 800 engaged thereon. Cover plate 800 may be formed from any suitable material, e.g., a plastic, and is configured to engage side rail 510 at a plurality of positions, e.g., at engagements 810, 820, 830, although greater or fewer engagements are also contemplated. Engagements 810, 820, 830 may include any suitable engagement mechanisms, fixed or releasable, e.g., bolts, latches, clips, etc., for securing cover plate 800 to side rail 510. Cover plate 800 is configured for positioning within the interior "saddle" defined by "C"-shaped portion 530 of side rail 510 and is provided to inhibit patients from becoming caught or entrapped within side rail 510. Cover plate 800 may further include indicia 840 provided thereon indicating a logo, information corresponding to side rail 510 such as model information or contact information, and/or instructions for use, e.g., instructions for rotating side rail 510 between the use and storage positions. Indicia 840 for other purposes are also contemplated, as is a cover plate 800 without any indicia 840.

Figure 6:
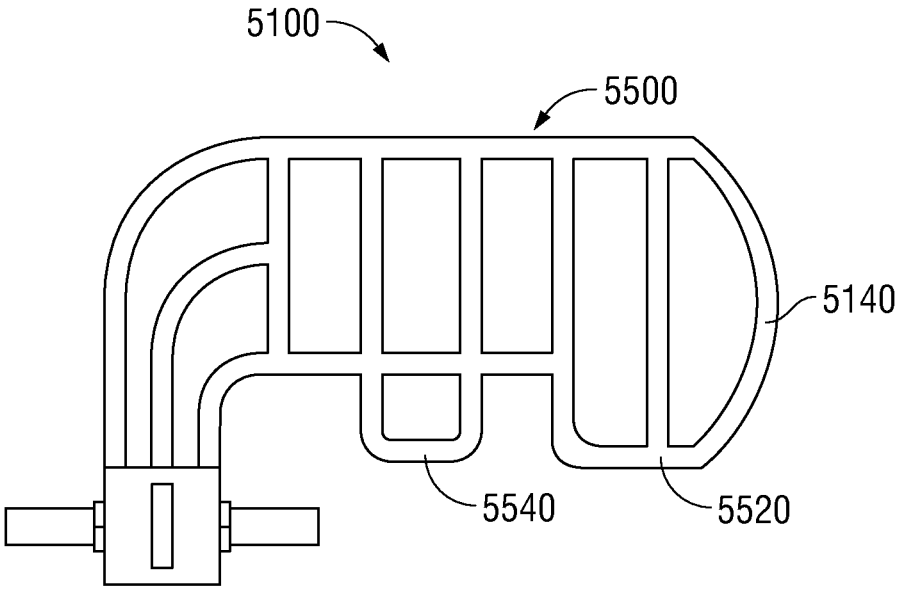
FIG. 6 is a side view of another embodiment of a side rail configured for use with the adjustable bed of FIG. 1.

With reference to FIG. 6, another embodiment of a side rail configured for use with bed system 10 (FIGS. 1-2) is shown generally identified by reference numeral 5100. Side rail 5100 is similar to side rail 51 (FIGS. 3A-3B) except that, in addition to a first downwardly-extending segment 5520 disposed at free end 5140 of side rail 5100, side rail 5100 further includes a second downwardly-extending segment 5540 extending intermediately from body portion 5500 that likewise inhibits a patient from extending any body part between side rail 5100 and mattress 700 (FIGS. 3A-3B) in the use position, thereby helping to inhibit the patient from being caught between side rail 5100 and mattress 700 (FIGS. 3A-3B).

Turning now to FIGS. 7A-7E, the features, use, and operation of actuation assembly 610 for locking side rail 51 in the storage and use positions, and unlocking side rail 51 to permit rotation of side rail 51 between the storage and use positions are described, although actuation assembly 610 may similarly be used in conjunction with side rail 510 (FIGS. 4A-4B) or side rail 5100 (FIG. 6). Actuation assembly 610 generally includes an outer housing 620 having an outer member 640 engaged therein, an inner sleeve member 630 rotatably disposed within outer member 640, and an actuator 650 coupled to inner member 630 and extending outwardly from outer housing 620. Outer housing 620 houses the internal working components of actuation assembly 610 and includes a portion of side rail 51 mounted thereto via any suitable mechanism or method, e.g., welding, bolting, latching, etc. Accordingly, outer housing 620 and side rail 51 are configured to rotate together between the storage and use positions (FIGS. 3A and 3B, respectively). Outer housing 620 further defines a pair of opposed slots 622, 624 and an actuator slot 626 therethrough.

Inner member 630 includes a extension portion 638 that extends from outer housing 620. A clamping mechanism 639 including first and second clamping jaws 639*a*, 639*b* is disposed at the free end of extension portion 638 of inner member 630 for mounting actuation assembly 610 on articulatable frame 200. Jaws 639*a*, 639*b* may be releasably clamped about articulatable frame 200 via latching, pin-aperture connections, or via any other suitable mechanism. Alternatively, clamping mechanism 639 may permanently affixed to articulatable frame 200, e.g., via welding, bolting, etc. Inner member 630 further includes a pair of opposed slots 632, 634, and an actuator slots 636 defined therethrough.

Outer member 640, as mentioned above, is rotatably disposed about inner member 630 and likewise includes a pair of opposed slots 642, 644 and an actuator slot 646 defined therethrough. Outer member 640 is rotatably engaged, e.g., fixed relative to, outer housing 620, which engages side rail 51. As such, and as will be described in greater detail below, outer housing 620 and outer member 640 are rotatable relative to inner member 630 between a first rotational orientation (FIGS. 7A and 7B) corresponding to the storage position of side rail 51, wherein slots 622, 632, 642 are aligned with one another and slots 624, 634, 644 are aligned with one another, and a second rotational orientation (FIGS. 7D and 7E) corresponding to the use position of side rail 51, wherein slots 622, 632, 644 are aligned with one another and slots 624, 634, 642 are aligned with one another.

Figure 7A:
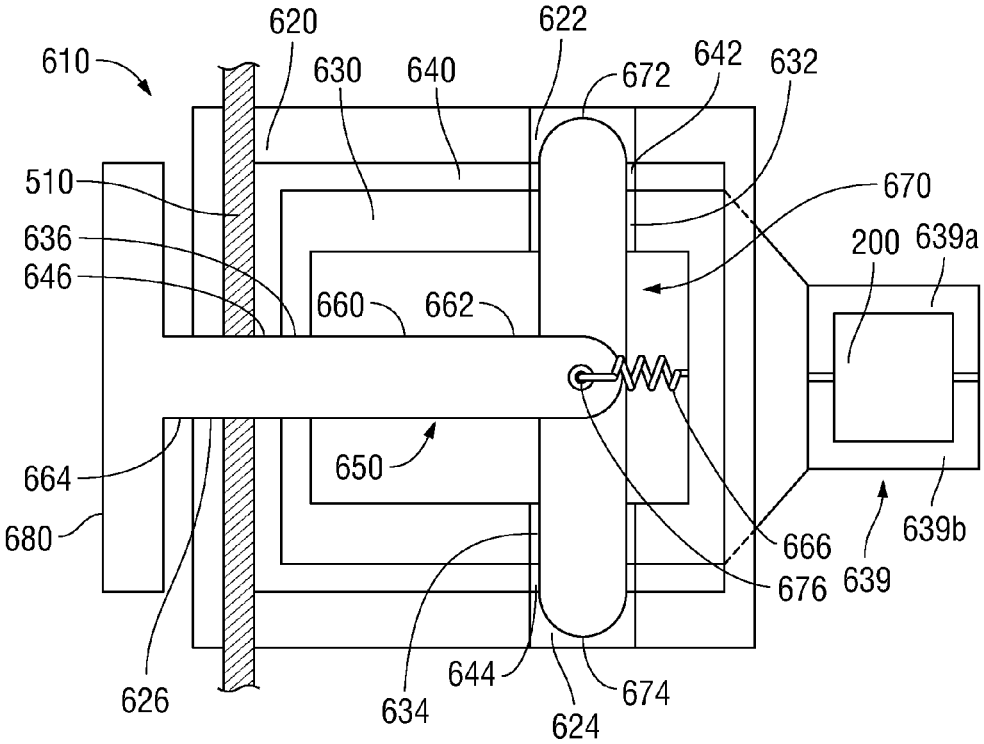
FIG. 7A is a cross-sectional view of the actuation assembly of the side rail of FIG. 3A, wherein the side rail is locked in the storage position.

Referring still to FIGS. 7A-7E, actuator 650 of actuation assembly 610 includes a shaft 660 having a locking mechanism 670 coupled thereto at a first end 620 thereof and a handle portion 680 disposed at a second end 664 thereof. First end 620 of shaft 660 extends through actuator slots 626, 636, 646 of outer housing 620 and inner and outer members 630, 640, respectively, such that locking mechanism 670 is disposed within inner member 630, while second end 664 of shaft 660 extends outwardly from outer housing 620 and inner and outer members 630, 640 such that handle portion 680 is readily graspable and manipulatable by a user. Shaft 660 is biased inwardly into inner and outer members 630, 640 and towards articulatable frame 200 by a biasing member 666, e.g., a coil spring, disposed between first end 620 of shaft 660 and an inner surface of inner member 630. Locking mechanism 670 includes first and second fingers 672, 674 pivotably coupled to first end 620 of shaft 660 via a pivot pin 676. Due to the inward bias of shaft 660 by biasing member 666, fingers 672, 674 are biased to extend in generally perpendicular orientation from shaft 660 in opposite directions relative to one another, as shown in FIG. 7A.

With reference to FIG. 7A, when side rail 51 is locked in the storage position, outer housing 620 and outer member 640 are disposed in the first rotational orientation relative to inner member 630, wherein slots 622, 632, 642 are aligned with one another and slots 624, 634, 644 are aligned with one another. In this position, shaft 660 is biased inwardly by biasing member 666, thus biasing fingers 672, 674 to extend perpendicularly from shaft 660 such that finger 672 extends through aligned slots 622, 632, 642, while finger 674 extends through aligned slots 624, 634, 644. This engagement of fingers 672, 674 within slots 622, 632, 642 and 624, 634, 644, respectively, rotatably locks outer housing 620 and outer member 640 in the first rotational orientation relative to inner member 630 and, thus, locks side rail 51 in the storage position.

Figure 7B:
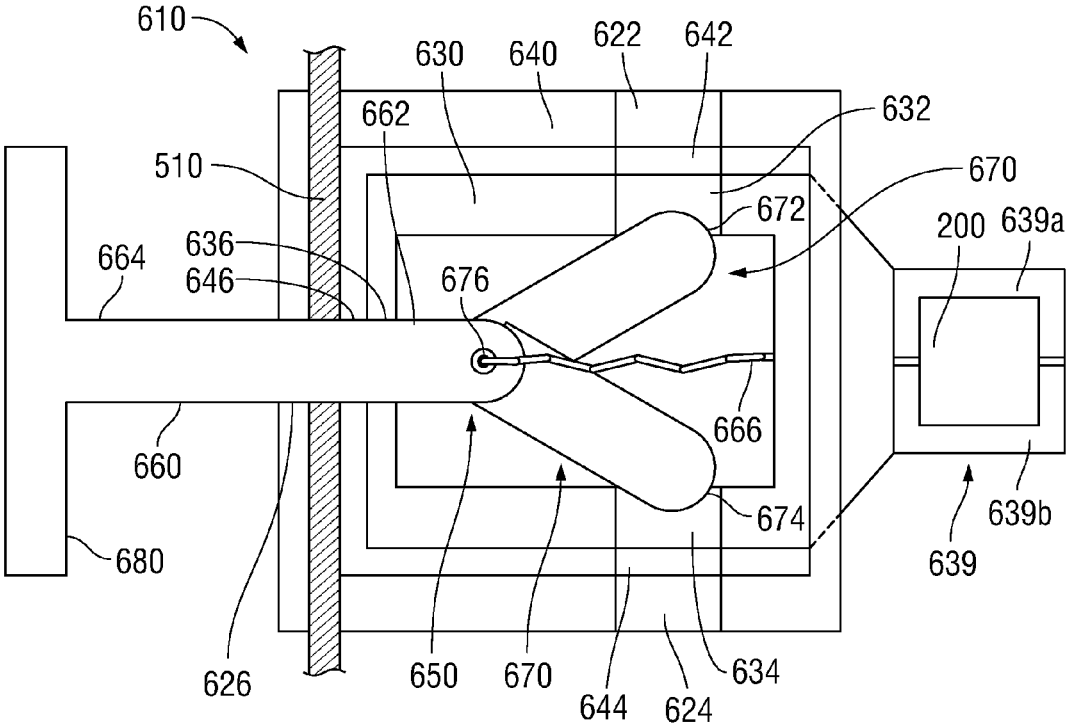
FIG. 7B is a cross-sectional view of the actuation assembly of FIG. 7A, wherein the side rail is being unlocked from the storage position.

With additional reference to FIG. 7B, in order to unlock side rail 51 from the storage position to permit rotation of side rail 51 to the use position, the user grasps handle portion 680 of shaft 660 and pulls shaft 660 outwardly against the bias of biasing member 666. This outward pulling of shaft 660 pivots fingers 672, 674 about pivot pin 676 and pulls fingers 672, 674 outwardly such that fingers 672, 674 are withdrawn from slots 622, 624 and slots 642, 644 of respective outer housing 620 and outer member 640, thereby unlocking side rail 51. That is, with fingers 672, 674 no longer engaged within slots 622, 624 and slots 642, 644, outer housing 620 and outer member 640 are permitted to rotate relative to inner member 630 and, thus, side rail 51 may be rotated from the storage position to the use position.

Figure 7C:
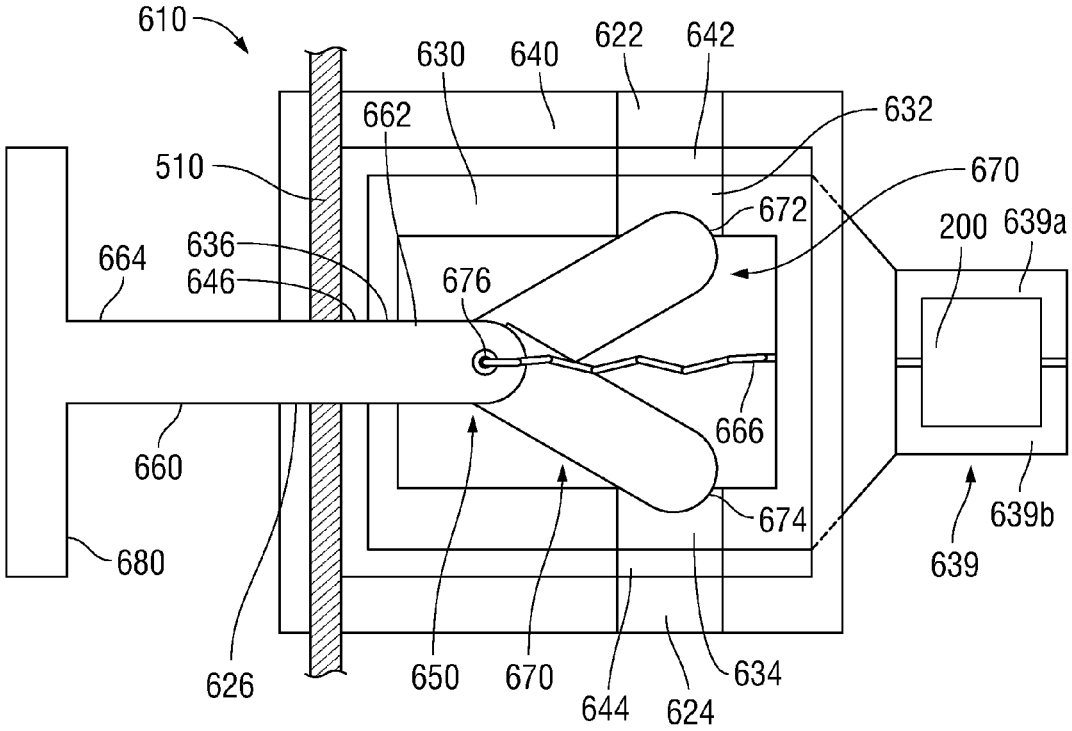
FIG. 7C is a cross-sectional view of the actuation assembly of FIG. 7A, wherein the side rail is being rotated to the use position.
Figure 7D:
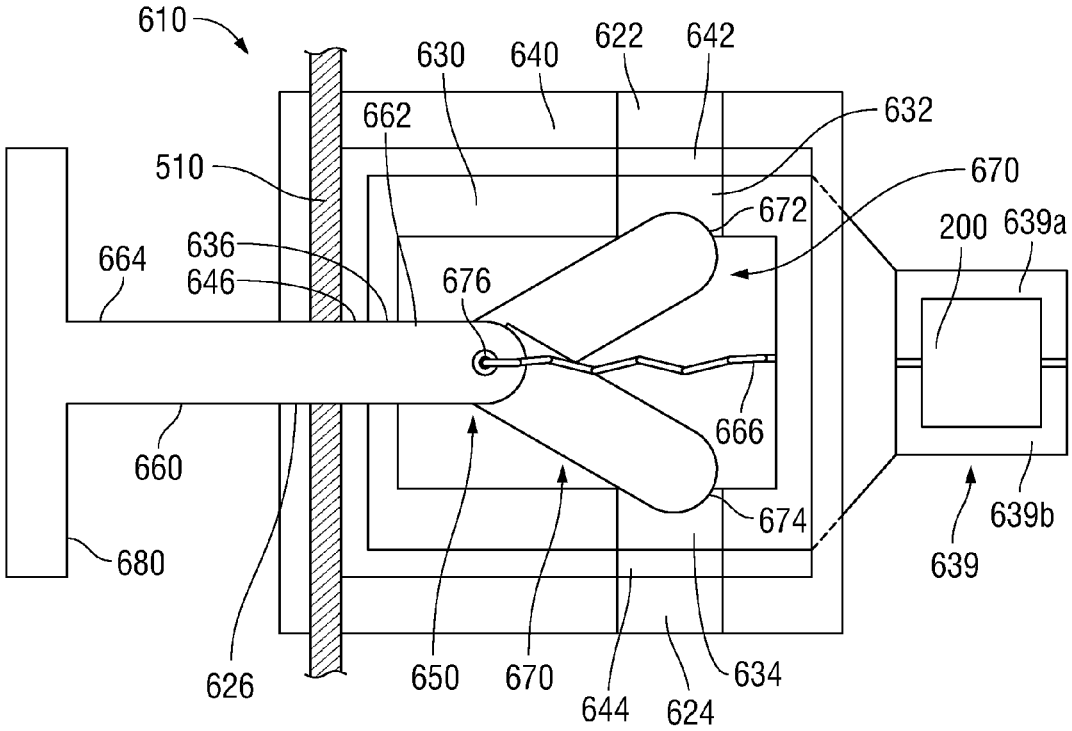
FIG. 7D is a cross-sectional view of the actuation assembly of FIG. 7A, wherein the side rail has been rotated to the use position.

Referring to FIGS. 7B-7D, with locking mechanism 670 disengaged, as detailed above, side rail 51 may be rotated from the storage position to the use position. As side rail 51 is rotated from the storage position to the use position, outer housing 620 and outer member 640 are rotated about inner member 630 from the first rotational orientation, wherein slots 622, 632, 642 are aligned with one another and slots 624, 634, 644 are aligned with one another (FIG. 7B); through intermediate rotational orientations, wherein none of slots 622, 624, 632, 634 are aligned with slots 642, 644 (FIG. 7C); to the second rotational orientation, wherein slots 622, 632, 644 are aligned with one another and slots 624, 634, 642 are aligned with one another (FIG. 7D).

Figure 7E:
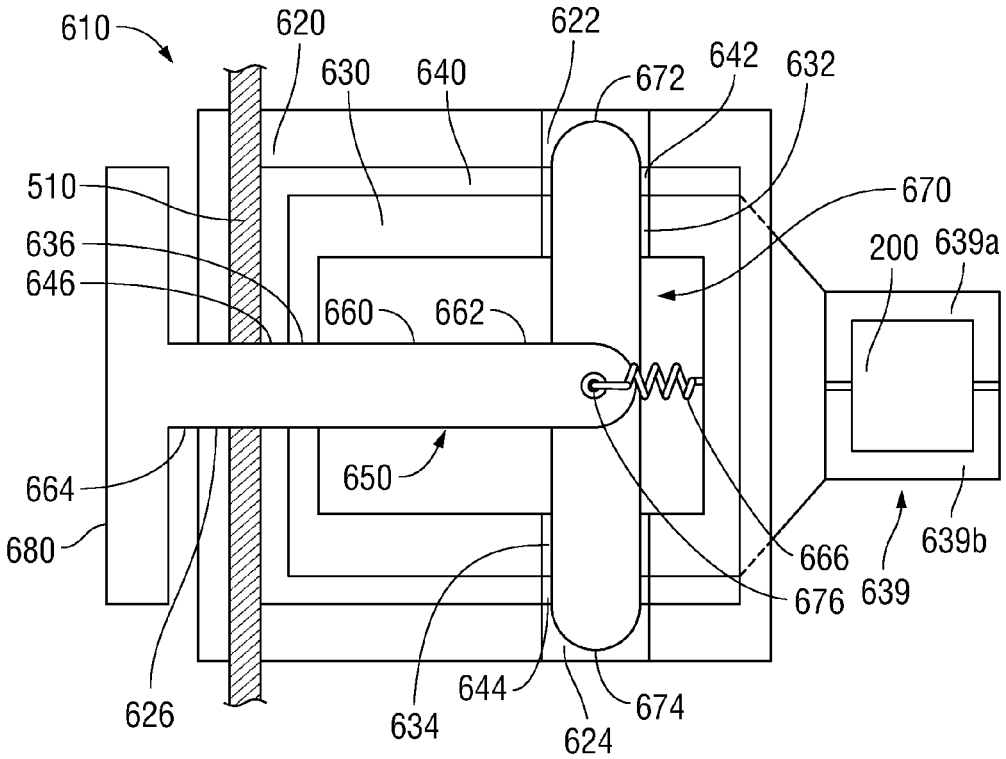
FIG. 7E is a cross-sectional view of the actuation assembly of FIG. 7A, wherein the side rail is locked in the use position.

Continuing with reference to FIG. 7D, and with additional reference to FIG. 7E, once side rail 51 has been rotated to the use position and, thus, once the second rotational orientation of outer housing 620 and outer member 640 has been achieved, shaft 660 is permitted to return inwardly under bias and/or may be return-assisted by manual inward urging of handle portion 680 of actuator 650, such that fingers 672, 674 are returned inwardly to once again extend perpendicularly from shaft 660. Upon return of fingers 672, 674 inwardly and to their respective perpendicular-extending positions, finger 672 extends through aligned slots 622, 632, 644, while finger 674 extends through aligned slots 624, 634, 642, as shown in FIG. 7E. This engagement of fingers 672, 674 within slots 622, 632, 644 and 624, 634, 642, respectively, rotatably locks outer housing 620 and outer member 640 in the second rotational orientation relative to inner member 630 and, thus, locks side rail 51 in the use position.

Referring again to FIGS. 7A-7E, in order to return side rail 51 to the storage position, the opposite of the above-described process is performed. Since the return process is just opposite of the process described above, return of side rail 51 to the storage position will only be summarily described hereinbelow. Initially, handle portion 680 of actuator 650 is pulled outwardly to disengage fingers 672, 674 from slots 622, 632, 644 and 624, 634, 642, respectively. Once disengaged, side rail 51 is rotated from the use position back to the storage position and, accordingly, outer housing 620 and outer member 630 are rotated about inner member 640 from the second rotational orientation back to the first rotational orientation. Once the first rotational orientation has been achieved, shaft 660 is returned inwardly such that fingers 672, 674 are returned inwardly and extend perpendicularly through engage slots 622, 632, 642 and 624, 634, 644, respectively, thereby locking side rail 51 in the use position.

The above description, disclosure, and figures should not be construed as limiting, but merely as exemplary of particular embodiments. It is to be understood, therefore, that the disclosure is not limited to the precise embodiments described, and that various other changes and modifications may be effected by one skilled in the art without departing from the scope or spirit of the present disclosure. Additionally, persons skilled in the art will appreciate that the features illustrated or described in connection with one embodiment may be combined with those of another, and that such modifications and variations are also intended to be included within the scope of the present disclosure. Therefore, the above description should not be construed as limiting, but merely as exemplifications of particular embodiments.

What is claimed is:

1. An adjustable side rail assembly, comprising:

a side rail rotatable between a storage position and a use position;

an actuation assembly, including:

an inner member defining first and second slots extending therethrough;

an outer member defining third and fourth slots extending therethrough, the outer member coupled to the side rail and rotatable relative to the inner member between first and second rotational orientations for rotating the side rail between the storage and use positions, respectively; and a locking assembly including a pair of fingers configured for releasable engagement within the slots of the inner and outer members to lock the inner and outer members in at least one of the first and second rotational orientations, the locking assembly transitional between a locked condition, wherein the locking assembly engages both the inner and outer members to fix the inner and outer members in at least one of the first and second rotational orientations, and an unlocked condition, wherein the locking assembly is disengaged from at least one of the inner and outer members to permit rotation of the outer member relative to the inner member between the first and second rotational orientations.

2. The adjustable side rail assembly according to claim 1, wherein, the fingers are configured for engagement within the first and third slots and the second and fourth slots to lock the inner and outer members in the first rotational orientation, and wherein the fingers are configured for engagement within the first and fourth slots and the second and third slots to lock the inner and outer members in the second rotational orientation.

3. The adjustable side rail assembly according to claim 1, wherein the actuation assembly further includes an actuator pivotably coupled to the pair of fingers, wherein the actuator is translatable between a first position for locking the inner and outer members in at least one of the first and second rotational orientations, and a second position permitting rotation of the outer member relative to the inner member.

4. The adjustable side rail assembly according to claim 3, wherein the actuator includes a handle extending from the inner and outer members, the handle configured for manual manipulation to translate the actuator between the first and second positions.

5. The adjustable side rail assembly according to claim 3, wherein the actuator is biased towards the first position.

6. The adjustable side rail assembly according to claim 3, wherein, in the first position, the fingers extend perpendicularly from the actuator and wherein, in the second position, the fingers extend obliquely from the actuator.

7. The adjustable side rail assembly according to claim 1, wherein the outer member further includes an outer housing fixedly disposed about the outer member, the outer housing engaging at least a portion of the side rail therein.

8. The adjustable side rail assembly according to claim 1, wherein the inner member includes an extension portion extending through the outer member, the extension portion including a clamping mechanism disposed at a free end thereof, the clamping mechanism configured for releasably engaging the actuation assembly to a bed frame.

9. The adjustable side rail assembly according to claim 1, wherein the side rail includes a body portion including at least one extension segment configured to inhibit a patient from being caught between the side rail and a bed.

10. The adjustable side rail assembly according to claim 1, wherein the side rail includes a "C"-shaped portion and an extension portion, the "C"-shaped portion secured to the outer member at a first end thereof and having the extension portion extending from a second end thereof.

11. The adjustable side rail assembly according to claim 1, further comprising a cover plate engaged to the side rail.

12. The adjustable side rail assembly according to claim 1, wherein the inner member includes an extension portion extending through the outer assembly, the extension portion including a clamping mechanism disposed at a free end thereof, the clamping mechanism configured for releasably engaging the actuation assembly to a bed frame.

13. An adjustable side rail assembly, comprising:

a side rail rotatable between a storage position and a use position;

an actuation assembly, including:

an inner member including first and second opposed slots;

an outer assembly rotatably disposed about the inner member and including the side rail secured thereto such that rotation of the outer assembly about the inner member between first and second rotational orientations effects rotation of the side rail between the storage and use positions, the outer assembly including third and fourth opposed slots, wherein, in the first rotational orientation, the first and third slots are aligned with one another and the second and fourth slots are aligned with one another, and wherein, in the second rotational orientation, the first and fourth slots are aligned with one another and the second and third slots are aligned with one another; and a pair of pivotable locking fingers, wherein in a storage locked condition, one finger extends through both the first and third slots and the other finger extends through both the second and fourth slots to lock the side rail in the storage position, wherein in a use locked condition, one finger extends through both the first and fourth slots and the other finger extends through both the second and third slots to lock the side rail in the use position, and wherein in an unlocked condition, the fingers are disengaged from at least the third and fourth slots to permit rotation of the side rail between the storage and use positions.

14. The adjustable side rail assembly according to claim 13, wherein the actuation assembly further includes an actuator pivotably coupled to the pair of fingers, wherein the actuation is translatable between a first position corresponding to the storage and use locked conditions, and a second position corresponding to the unlocked condition.

15. The adjustable side rail assembly according to claim 14, wherein the actuator includes a handle extending from the inner member and the outer assembly, the handle configured for manual manipulation to translate the actuator between the first and second positions.

16. The adjustable side rail assembly according to claim 14, wherein the actuator is biased towards the first position.

17. The adjustable side rail assembly according to claim 14, wherein, in the first position, the fingers extend perpendicularly from the actuator and wherein, in the second position, the fingers extend obliquely from the actuator.

18. The adjustable side rail assembly according to claim 13, further comprising a cover plate engaged to the side rail.

* * * * *